US010295246B2

(12) United States Patent
Heisswolf et al.

(10) Patent No.: US 10,295,246 B2
(45) Date of Patent: May 21, 2019

(54) METHOD FOR ADJUSTING THE POSITION OF A DOOR OF A HOUSEHOLD REFRIGERATION APPLIANCE, AND HOUSEHOLD REFRIGERATION APPLIANCE

(71) Applicant: BSH HAUSGERAETE GMBH, Munich (DE)

(72) Inventors: Tobias Heisswolf, Syrgenstein (DE); Simon Kraemer, Aalen (DE); Alfred Raab, Huettlingen (DE); Christian Schmid, Neu-Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/834,648

(22) Filed: Dec. 7, 2017

(65) Prior Publication Data

US 2018/0156531 A1 Jun. 7, 2018

(30) Foreign Application Priority Data

Dec. 7, 2016 (DE) ..... 10 2016 224 383

(51) Int. Cl.

| | |
|---|---|
| ***F25D 23/02*** | (2006.01) |
| ***E05D 3/02*** | (2006.01) |
| ***E05D 7/04*** | (2006.01) |
| ***E05D 7/081*** | (2006.01) |

(52) U.S. Cl.

CPC ..... *F25D 23/028* (2013.01); *E05D 3/02* (2013.01); *E05D 7/0415* (2013.01); *E05D 7/0423* (2013.01); *E05D 7/081* (2013.01); *E05Y 2900/31* (2013.01); *F25D 2323/024* (2013.01); *F25D 2500/02* (2013.01)

(58) Field of Classification Search

CPC ..... F25D 23/028; F25D 2323/024; F25D 2500/02; E05D 3/02; E05D 7/0415; E05D 7/0423; E05D 7/081; E05Y 2900/31

See application file for complete search history.

(56) References Cited

U.S. PATENT DOCUMENTS

| | | | | |
|---|---|---|---|---|
| 2,441,221 A * | 5/1948 | Eckel | ..... | E05D 7/0423 16/245 |
| 3,389,424 A * | 6/1968 | Fellwock | ..... | E05D 7/02 16/392 |
| 4,406,087 A * | 9/1983 | Asaka | ..... | E04H 9/02 49/381 |
| 5,500,983 A * | 3/1996 | Lautenschlager | ..... | E05D 7/04 16/292 |

(Continued)

*Primary Examiner* — Hanh V Tran

(74) *Attorney, Agent, or Firm* — Laurence A. Greenberg; Werner H. Stemer; Ralph E. Locher

(57) ABSTRACT

A method for adjusting a position of a door on a housing of a household refrigeration appliance to change a placement of the door while located on the housing, includes separating a door leaf of the door from a front flange of the housing in a depth direction of the household refrigeration appliance by a gap in a closed state of the door. A tool is inserted into the gap and a readjustment element, which can be accessed through the gap, is readjusted by using the tool in such a way that the position of the door relative to the housing is changed in dependence on the readjustment of the readjustment element. A household refrigeration appliance is also provided.

12 Claims, 4 Drawing Sheets

(56) References Cited

U.S. PATENT DOCUMENTS

| | | | | |
|---|---|---|---|---|
| 7,429,091 | B2 * | 9/2008 | Reed | E05D 11/1078 312/351 |
| 8,382,219 | B2 * | 2/2013 | Hottmann | A47B 88/95 312/348.4 |
| 8,388,074 | B1 * | 3/2013 | Donberger | A47B 96/20 312/204 |
| 8,894,168 | B2 * | 11/2014 | Lee | F25D 23/028 312/405 |
| 9,752,817 | B2 * | 9/2017 | Richards | F25D 23/028 |
| 2008/0034539 | A1 * | 2/2008 | Lyvers | E05D 7/0423 16/238 |
| 2008/0168618 | A1 * | 7/2008 | Hottmann | E05F 1/1253 16/50 |
| 2009/0289536 | A1 * | 11/2009 | Park | F25D 23/028 312/405 |
| 2010/0033067 | A1 * | 2/2010 | Kim | F25D 23/028 312/236 |

* cited by examiner

METHOD FOR ADJUSTING THE POSITION OF A DOOR OF A HOUSEHOLD REFRIGERATION APPLIANCE, AND HOUSEHOLD REFRIGERATION APPLIANCE

CROSS-REFERENCE TO RELATED APPLICATION

This application claims the benefit, under 35 U.S.C. § 119, of German Patent Application DE 10 2016 224 383.7, filed Dec. 7, 2016; the prior application is herewith incorporated by reference in its entirety.

BACKGROUND OF THE INVENTION

Field of the Invention

The invention relates to a method for adjusting the position of a door on a housing of a household refrigeration appliance in which the placement of the door while located on the housing is changed. When the door is in its closed state, a leaf of the door is located so as to be separated from a front flange of the housing by a gap, as viewed in a depth direction of the household refrigeration appliance. The invention further relates to a household refrigeration appliance.

In known household refrigeration appliances, it is important for the placement of the front doors to be precisely aligned with the housing, so that no tilting is visible from the front. Any such tilting relative to the housing is also noticeable in relation to further parts which are located directly adjacent the door at the front of the household refrigeration appliance. If such a household refrigeration appliance has a second door at the front, for example, an imprecise placement of the first door relative to the housing then means an imprecise placement relative to that further door. Any gaps that are present between such doors are then uneven over their entire length, which is likewise visible from the front, and results in a visual appearance which is qualitatively disadvantageous as well as possibly restricting or preventing an intended insertion of the fingers into such a gap in order to reach behind a door, for example. That can also cause deflection or rubbing of the door against other parts of the appliance during movement.

SUMMARY OF THE INVENTION

It is accordingly an object of the invention to provide a method for adjusting the position of a door of a household refrigeration appliance, and a household refrigeration appliance, which overcome the hereinafore-mentioned disadvantages of the heretofore-known methods and appliances of this general type and which permit the position of a door to be adjusted easily, quickly and precisely.

With the foregoing and other objects in view there is provided, in accordance with the invention, a method for adjusting the position of a door of a household refrigeration appliance, in which the door is pivotably located on a housing of the household refrigeration appliance. In this case, the placement of the door while located on the housing is changed. When the door is in its closed state, a leaf of the door is located so as to be separated by a gap from a front flange of the housing, as viewed in a depth direction of the household refrigeration appliance. It is considered an important concept of the invention that a tool is inserted into the gap and a readjustment element which is accessible through the gap on the household refrigeration appliance is readjusted by using the tool in such a way that the position of the door relative to the housing is changed in at least one spatial direction as a function of this readjustment of the readjustment element. By virtue of such an embodiment, it is possible to quickly and precisely readjust the placement and hence the position of the door relative to the housing. In particular, the tool can be applied directly to the readjustment element through the gap, without first having to remove extensive cover parts or the like in order to be able to reach the readjustment element. Moreover, by virtue of this embodiment, the readjustment element is nonetheless located so as to be protected and effectively accommodated in the gap.

In particular, the gap is widened in a depth direction of the household refrigeration appliance at an end region, in particular an upper and/or lower end region as viewed in a height direction of the household refrigeration appliance, thereby forming an access channel in the gap, through which the tool can be introduced and can reach the readjustment element and directly engage therewith in the access channel.

The gap is preferably open towards the side in a width direction of the household refrigeration appliance, and the tool is introduced into the gap in a width direction and engaged with the readjustment element. Since the side access is particularly simple and the operation of the tool is also ergonomically very user friendly, this is a particularly advantageous embodiment. Since the access point can easily be found from the side and the user has a degree of view into the gap, the engagement of the tool with the readjustment element can be effected easily and reliably when then tool is introduced into the gap.

Provision can also be made for the gap to be open towards the top and/or the bottom as seen in the height direction of the household refrigeration appliance, and for the tool to be introduced into the gap in this height direction and engaged with the readjustment element. This also has a corresponding advantages in specific embodiments.

The readjustment element is preferably oriented or aligned in a width direction of the household refrigeration appliance. The readjustment element is preferably readjusted in a width direction in order to change the position of the door relative to the housing. In particular, this allows the position of the door to be changed relative to the housing in this width direction. An identical orientation of both the introduction of the tool into the gap, and the orientation of the readjustment element and the movement of the readjustment element, is therefore associated with the direction in which it is then possible to modify the position of the door. This provides a particularly intuitive readjustment concept for a user, in such a way that even in the case of very small and precisely controlled positional changes, modifying the position and implementing the change can be effected quickly and understood easily.

Provision is preferably made for the door to be pivotably mounted on the housing by using a bearing device, wherein the bearing device has a bearing angle adjustment plate which is rotatably connected to the door and a separate bearing angle base plate which is statically located on the housing. The bearing angle adjustment plate is connected to the bearing angle base plate through the readjustment element, and the bearing angle base plate and the bearing angle adjustment plate are moved relative to each other by operating the readjustment element in order to effect a change in the position of the door relative to the housing accordingly. This multicomponent structure of the bearing device allows both an embodiment which requires minimal structural space and a very simple concept for readjusting the placement of the door on the housing. The two plates per se are relatively robust and mechanically highly resilient parts, which are located in such a way that they can be moved relative to each other. The two above-mentioned plates are moreover so oriented as to be parallel to each other and overlap sectionally. It is thereby possible to achieve both a particularly effective engagement and a particularly simple concept for the movement of the plates relative to each other, even in the engaged state.

The bearing angle adjustment plate is preferably moved in a width direction of the household refrigeration appliance relative to the bearing angle base plate, in order to change the position of the door relative to the housing. In this case, it is not intended for the bearing angle adjustment plate as a whole to be displaced relative to the door on which the bearing angle adjustment plate is located, and in this regard only a rotational movement of these two components relative to each other is possible.

In a further advantageous embodiment, the bearing angle base plate is so constructed as to include an engagement peg, which passes through an opening in the bearing angle adjustment plate. The readjustment element is connected to that section of the engagement peg which passes through the opening and to an engagement peg of the bearing angle adjustment plate which extends parallel to the engagement peg of the bearing angle base plate. By virtue of such an embodiment, the readjustment element is raised and positioned in an offset manner relative to the two plates, thereby allowing simple and clear access for the tool and moreover allowing very precise control of the device for readjustment. Specifically, a transfer of force initially takes place to the effect that these two engagement pegs are directly connected to the readjustment element, and by using a corresponding readjustment of the readjustment element a direct force effect on these two engagement pegs takes place. The location and embodiment of the engagement pegs also generates a correspondingly effective path of force, which is then transferred to the two plates, in such a way that they can also be moved relative to each other with very precise control and accurate placement. This in turn has a corresponding positive effect on the readjustment of the placement of the door relative to the housing.

A relative position that is adjusted between the bearing angle adjustment plate and the bearing angle base plate is preferably fixed. The resulting adjustment of the position of the door relative to the housing is thereby fixed correspondingly.

A locking screw is preferably tightened for the purpose of fixing the position. With respect to its screw direction, the locking screw is preferably oriented in a different spatial direction than the readjustment element, in particular perpendicular thereto. The locking screw is preferably oriented in a height direction, in such a way that the locking action or locking force acts in this height direction. The bearing angle adjustment plate and the bearing angle base plate are preferably oriented in a horizontal plane, which therefore extends over the width direction and the depth direction.

The adjustment of the door position is preferably performed when the door is in its fully closed state. This is a further very advantageous embodiment, since it means that the door does not have to be opened before it can be brought into a readjustment position relative to the housing, and therefore for the purpose of such adjustments to the placement of the door it is consequently not necessary to establish an adjustment position for the door before the tool can be used, and it is instead already possible to operate the tool immediately in this closed position of the door. Therefore the assembly is very quick and a corresponding readjustment of the door position is immediately apparent, since in particular the closed setting of the door helps to make an imprecise placement particularly noticeable. When the position of the door is readjusted by applying the tool to the readjustment element in this closed setting, the modified placement of the door relative to adjacent components is therefore also immediately apparent.

An adjustment screw is preferably used as a readjustment element, wherein the position of the door is adjusted by turning the adjustment screw.

In a further advantageous embodiment, provision is made for the bearing angle base plate to have at least one integrated guide peg which projects through a guide slot in the bearing angle adjustment plate in such a way that, in addition to the advantageous embodiment in which the engagement pegs of the two plates are so oriented as to correspond to each other, a separate mechanical engagement is thereby realized at a distance from the engagement pegs. The straight-line linear movement between the plates is thereby aided to a considerable extent in particular, and is again specifically guided by this additional guide peg. In particular, the straight-line readjustment of the door relative to the housing is thereby assisted in a particularly advantageous manner.

The embodiment including the readjustment element also allows a continuous and therefore stepless adjustment of the position of the door relative to the housing.

The orientation of the locking screw means that it is easily accessible from above and is not covered, so that in this case this locking screw can likewise be found quickly and operated immediately by using a corresponding tool.

With the objects of the invention in view, there is concomitantly provided a household refrigeration appliance, which is constructed in particular to perform a method according to invention or an advantageous embodiment thereof and which comprises a housing on which a door is pivotably located, the door allowing a storage space for food to be sealed at the front and the storage space being provided in the housing. The household refrigeration appliance has an adjustment device for adjusting a position of the door relative to the housing. It is considered an important concept of the household refrigeration appliance that a gap is formed between the door and a front flange of the housing, at least when the door is in its closed state, providing an access channel to the adjustment device. A tool can be introduced directly into this access channel, and a readjustment element of the adjustment device is located in such a way that it can be engaged by the tool that has been introduced into the access channel and then readjusted, whereby the position of the door can be adjusted accordingly. Advantageous embodiments of those material components of the household refrigeration appliance mentioned above with reference to the method, in particular the bearing device, are also considered to be advantageous embodiments of the household refrigeration appliance.

The bearing angle adjustment plate is located so as to overlap the bearing angle base plate at least sectionally, and is located above the bearing angle base plate in a vertical direction and positioned so as to be seated thereon.

Any references to "above," "below," "in front of," "behind," "horizontal," "vertical," "depth direction," "width direction," "height direction," etc. refer to positions and orientations which assume a standard use and standard location of the appliance and an observer then standing in front of the appliance and looking in the direction of the appliance.

Further features of the invention are derived from the claims, the figures and the description of the figures. The features and combinations of features cited in the foregoing description, and the features and combinations of features cited in the following description of the figures and/or shown in the figures alone, are not used solely in the respective combination specified, but can also be used in other combinations without thereby departing from the scope of the invention. Consequently, the invention is considered to encompass embodiments which are not explicitly shown and explained in the figures, but which are suggested by the embodiments that are explained and can be derived therefrom by separate combinations of features. Therefore embodiments and combinations of features are also considered to be disclosed which do not have all the features specified in the original wording of an independent claim. Moreover and in particular by virtue of the embodiments explained above, embodiments and combinations of features are considered to be disclosed which extend beyond or deviate from the combinations of features stated in the back-references of the claims.

Other features which are considered as characteristic for the invention are set forth in the appended claims.

Although the invention is illustrated and described herein as embodied in a method for adjusting the position of a door of a household refrigeration appliance, and a household refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
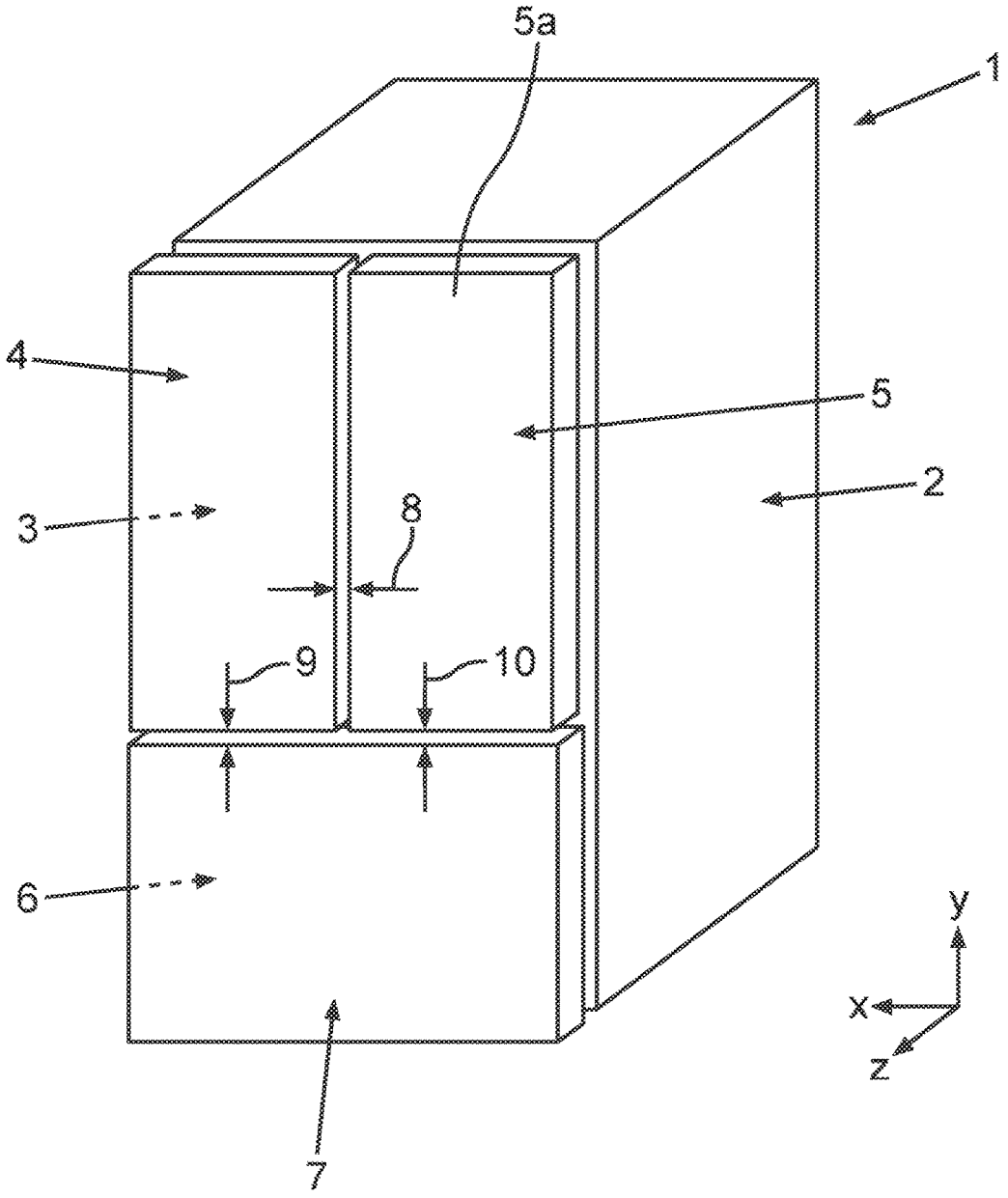
FIG. 1 is a diagrammatic, perspective view of an exemplary embodiment of a household refrigeration appliance according to the invention.

Referring now in detail to the figures of the drawings, in which identical or functionally identical elements are denoted by the same reference characters, and first, particularly, to FIG. 1 thereof, there is seen a perspective view of a household refrigeration appliance 1, which may be constructed as a refrigerator or a freezer. The household refrigeration appliance 1 in the exemplary embodiment is constructed as a combined refrigerator-freezer appliance. The appliance has a housing 2 in which a storage space 3 for food is formed. In particular, the storage space 3 in this case is a refrigeration appliance compartment. The storage space 3 is delimited by walls of a non-illustrated inner container. In the exemplary embodiment, provision is made for this storage space 3 to be sealed on the front side by not just one door, which is also possible, but by two separate doors 4 and 5. Each of the doors 4 and 5 can pivot about a vertical swivel axis, which is therefore oriented in a height direction (y-direction).

In the exemplary embodiment, the household refrigeration appliance 1 also has a further storage space 6, a freezer compartment in this case, which is separate from the first storage space 3. This further storage space 6 can be sealed at the front by a further separate door 7. This door 7 is preferably a front wall of a drawer which can be pushed in and pulled out in a depth direction (z-direction).

It can be seen that a gap 8 is formed between the two doors 4 and 5. A further gap 9 is also formed between the door 4 and the door 7. A gap 10 is likewise formed between the door 5 and the door 7. In order to ensure functionally reliable operation of the doors over the long-term, and their operability when grasped by a user in particular, it is particularly advantageous if these gaps 8, 9 and 10 are adjusted precisely. Moreover, the adjustment of a precise gap dimension is also particularly advantageous with regard to a soothing high-quality appearance.

Figure 2:
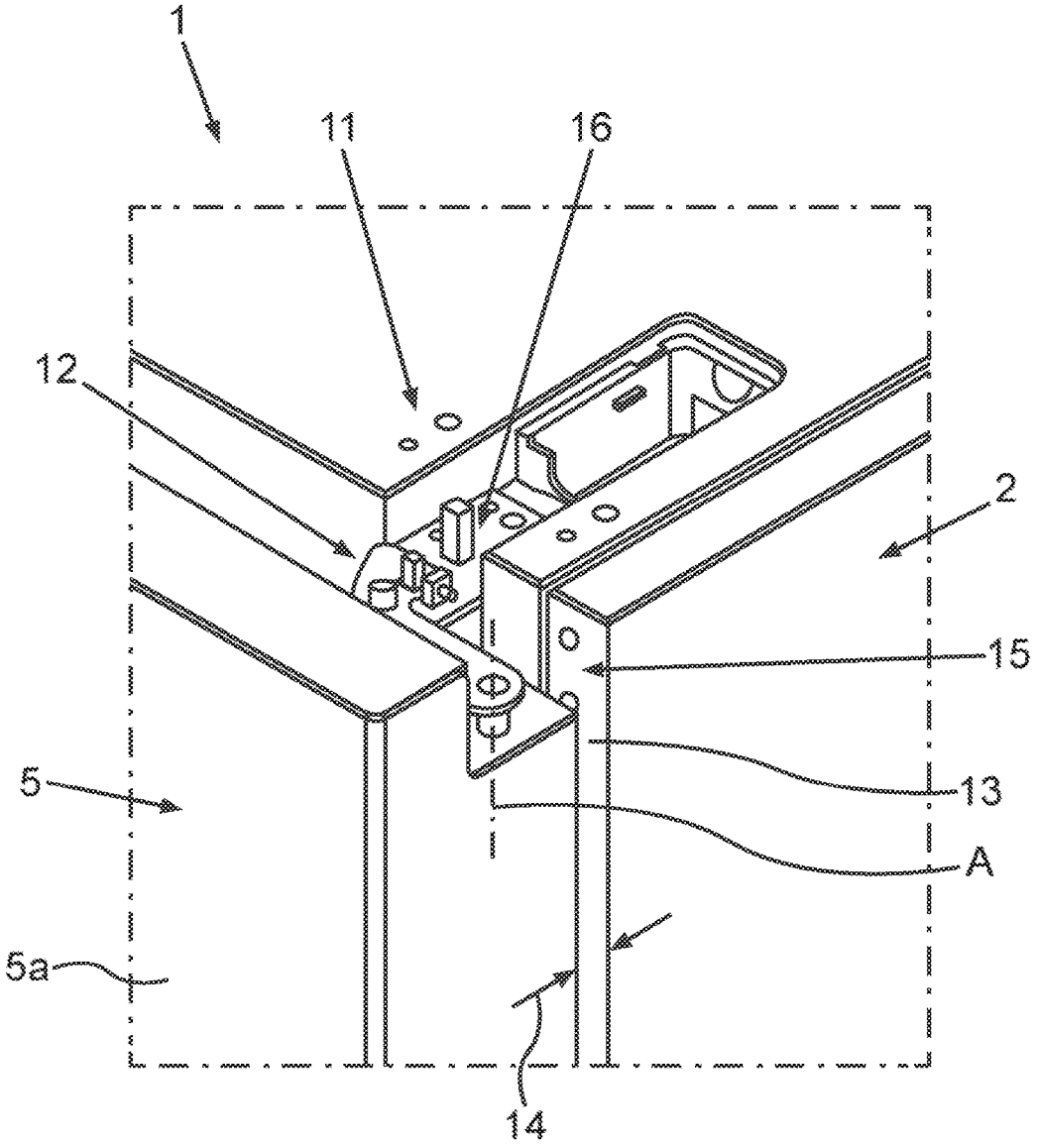
FIG. 2 is an enlarged, fragmentary, perspective view of an upper front corner region of the household refrigeration appliance according to FIG. 1, with a door at the front being pivotably located on the housing.

FIG. 2 shows an upper front corner region 11 of the household refrigeration appliance 1 in an enlarged view. As is shown therein, the door 5 can pivot about a swivel axis A relative to the housing 2. A bearing device 12 is provided for this purpose, through the use of which the door 5 is pivotably located on the housing 2. This door 5 is shown in the closed state in FIG. 2 as in FIG. 1. It can be seen in this case that a defined gap 14 is formed between a door leaf 5*a* of the door 5 and a front flange 13 of the housing 2, and therefore the gap 14 also extends in a width direction and thus an x-direction as far as the bearing device 12, in such a way that this gap 14 also forms and provides an access channel 15 through which it is possible to gain access to the bearing device 12 by lateral insertion. In the exemplary embodiment, the access channel 15 is formed at an upper end region of the gap 14. The access channel 15 is larger or widened in a depth direction in comparison with the remainder of the gap, and therefore insertion of a tool 32 and visibility are also easier. In the region of this bearing device 12, the household refrigeration appliance 1 also has an adjustment device 16 through the use of which it is possible to adjust a position of the door 5, in particular the door leaf 5*a*, relative to the housing 2, in particular in a width direction. It is also possible to reach the adjustment device 16 directly through the access channel 15, in particular by using a tool.

Figure 3:
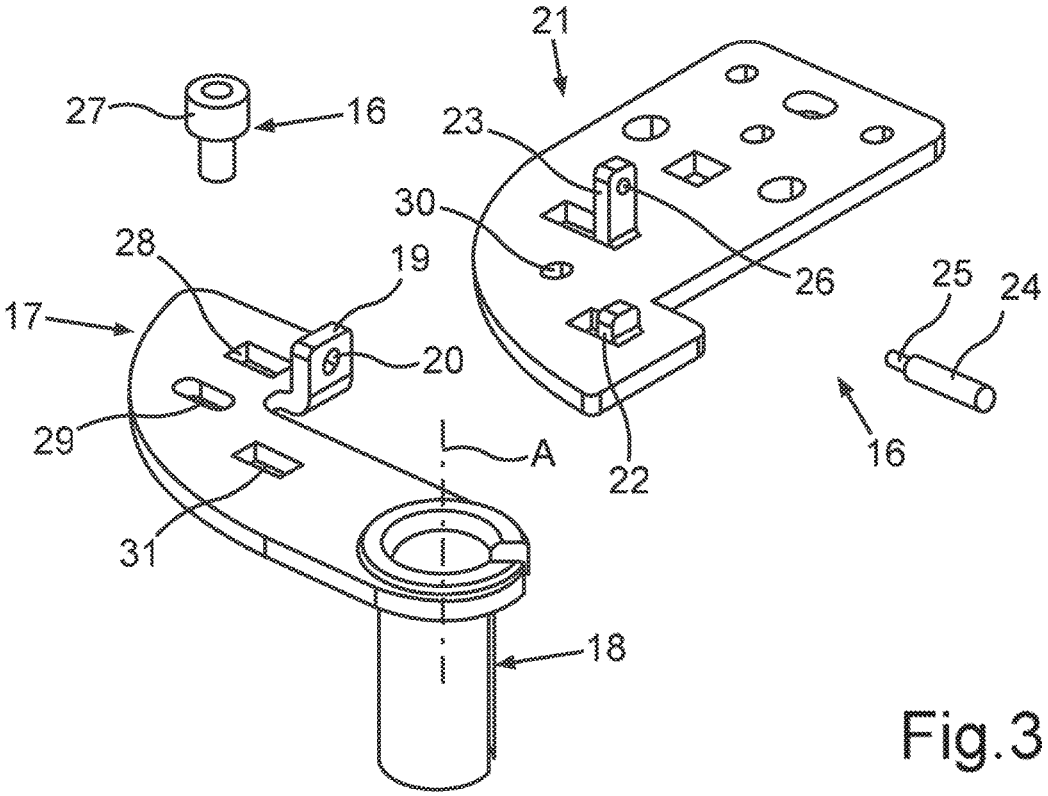
FIG. 3 is a further enlarged, exploded perspective view of components of a bearing device and an adjustment device of the household refrigeration appliance, for mounting and adjusting a door on the housing.

FIG. 3 shows a view of components of the bearing device 12 in an exploded view. This bearing device 12 includes a bearing angle adjustment plate 17, which is L-shaped. An engagement pin 18, which is formed integrally on or in one-piece with the bearing angle adjustment plate 17, projects into a support in the door 5, so that the door 5 can then pivot about the engagement pin 18.

The bearing angle adjustment plate 17 also has an engagement peg 19 which is formed integrally on or in one-piece with the bearing angle adjustment plate 17. The engagement peg 19 is a bent bracket and bends upwards at a projecting end of the bearing angle adjustment plate 17. The projecting end is opposite to the end at which the engagement pin 18 is formed. This engagement bracket or engagement peg 19 has an opening 20 which, in particular, can also include an internal thread. Furthermore, the bearing device 12 has a bearing angle base plate 21 which is separate from the bearing angle adjustment plate 17 and is located on the housing 2 in a positionally fixed manner. This bearing angle base plate 21 likewise is preferably L-shaped. The bearing angle base plate 21 has a guide peg 22 which forms an integral part of the bearing angle base plate 21 or is formed in one-piece therewith and projects upwards from the plane of the bearing angle base plate 21. The exemplary embodiment includes a second engagement peg 23 at a distance from the guide peg 22. The engagement peg 23 is likewise formed as an integral part of the bearing angle base plate 21 or is formed in one-piece with the bearing angle base plate 21 and extends upwards in a raised manner above the plane of the bearing angle base plate 21.

Figure 4:
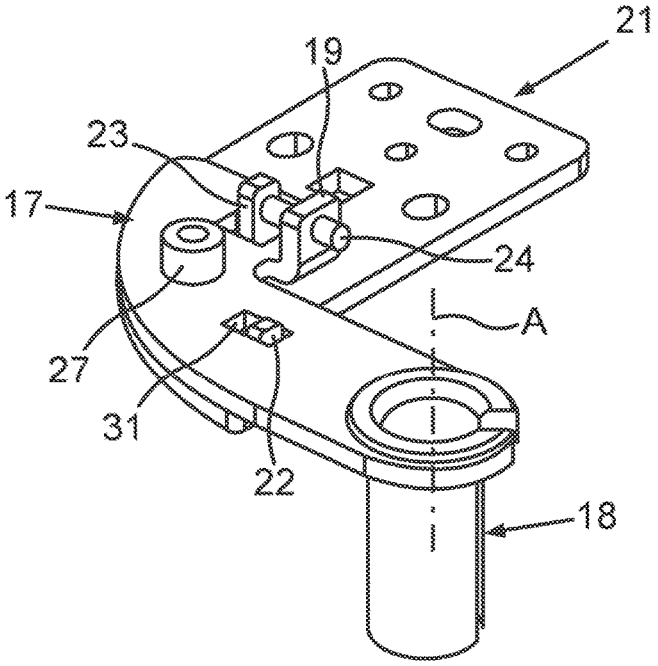
FIG. 4 is a perspective view of the components according to FIG. 3 in an assembled state.

The embodiment shown in FIG. 3 also illustrates the adjustment device 16, which includes in particular the engagement peg 19 and the engagement peg 23. The adjustment device 16 further includes a separate readjustment element 24, which is an adjustment screw. In the assembled state as shown in FIG. 4, the adjustment screw extends through the opening 20 in the engagement peg 19 and engages in the corresponding thread if this option is present. If applicable, the adjustment screw then has an external counter thread for this purpose.

An insertion region 25 of the readjustment element 24 is introduced into a support 26 in the engagement peg 23 of the bearing angle base plate 21. Furthermore, the adjustment device 16 also has a locking screw 27, through the use of which it is possible to fix an adjusted position between the bearing angle adjustment plate 17 and the bearing angle base plate 21, and a resulting adjusted position between the door 5 and the housing 2.

As is shown in FIG. 4, the engagement peg 23 extends through an opening 28 in the bearing angle adjustment plate 17 in such a way that a section of this engagement peg 23 passes through an opening 28 and projects upwards, so that this section then provides for the engagement with the readjustment element 24. Furthermore, FIG. 4 also shows the screwed-in state of the readjustment element 24 in the opening 20. It can also be seen in FIG. 4 that the locking screw 27 passes through an opening 29 in the bearing angle adjustment plate 17 and engages with (in particular screws into) an opening 30 in the bearing angle base plate 21 and is screwed down by using a corresponding internal thread.

The guide peg 22 is introduced into a guide slot 31 in the bearing angle adjustment plate 17 and can be linearly moved therein in practice.

Figure 5:
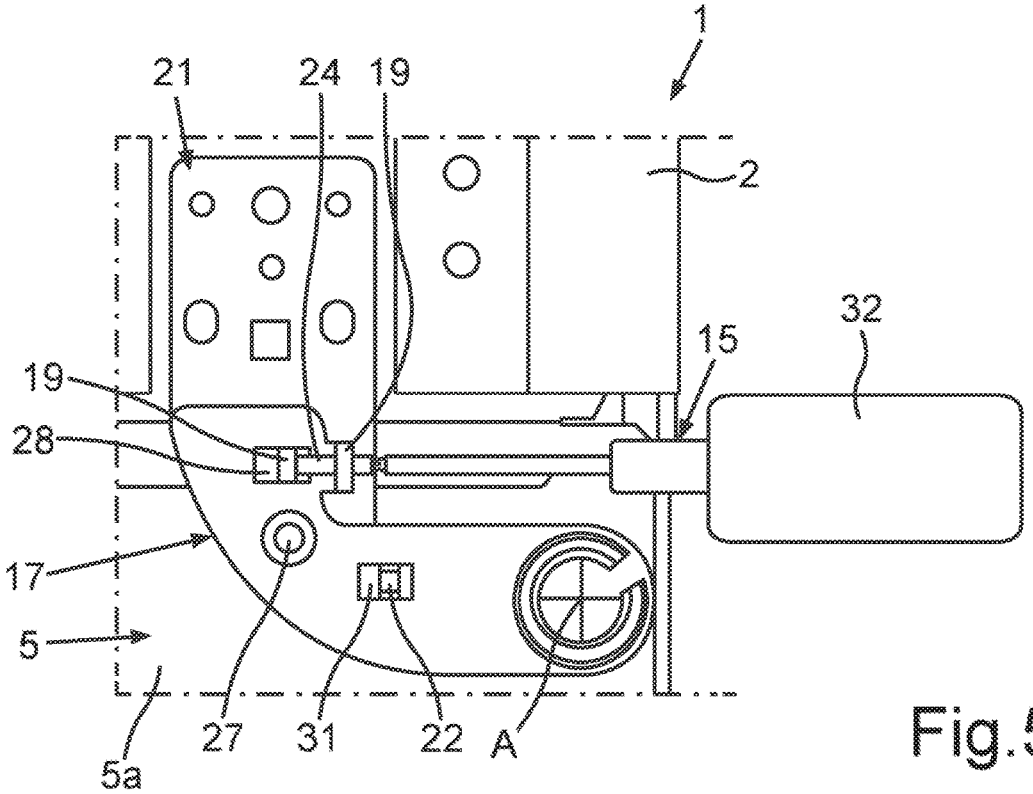
FIG. 5 is a top-plan view of the appliance shown in FIG. 2 with a first adjusted position of the door relative to the housing.

FIG. 5 is a plan view of the illustration shown in FIG. 2. It can be seen in this case that the bearing angle adjustment plate 17 is located so as to overlap the bearing angle base plate 21 sectionally, and the plates lie flat against each other in this regard. The opening 28 and the guide slot 31 are oriented parallel to each other with respect to their elongated hole geometry, and are oriented in a width direction of the household refrigeration appliance 1. Correspondingly, the guide peg 22 and the engagement peg 19 can be moved in these respective elongated holes concurrently and in parallel with each other in a width direction. The adjustment of the door 5 relative to the housing 2 can therefore take place largely in a straight line.

Starting from a normal position shown in FIG. 5, the adjustment of the door 5 is effected, for example, by first loosening the locking screw 27 which is preferably present and positionally fixes this normal position. The tool 32, in particular a screwdriver, is inserted from the side, as viewed in a width direction, into the gap 14. The screwdriver is inserted into the access channel 15 in particular until it reaches the adjustment screw, which is in the form of the readjustment element 24, that is freely accessible through the access channel 15. It can be seen in FIG. 5 that this readjustment element 24 is likewise oriented in a width direction. If a rotational movement is now transferred to this readjustment element 24 by using the screwdriver, a relative positional change is effected between the bearing angle adjustment plate 17 and the bearing angle base plate 21, and these two plates are now moved relative to each other in a width direction as a result.

Figure 6:
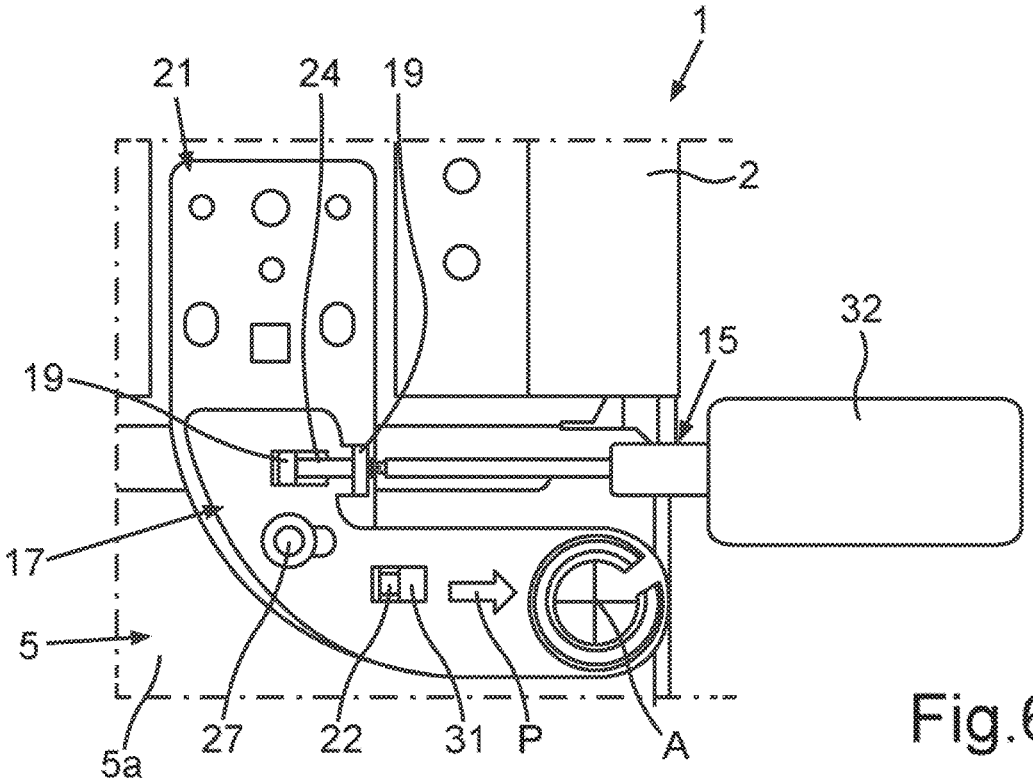
FIG. 6 is a top-plan view of the appliance shown in FIG. 2, in which the door has been readjusted outwards in a width direction relative to the housing in comparison with the view of FIG. 5.

FIG. 6 accordingly shows a moved position, in which the bearing angle adjustment plate 17 has been moved linearly outwards in a width direction relative to the bearing angle base plate 21. As a result of this movement, the door 5 is also moved to the same extent outwards in this width direction relative to the housing 2, and the position of the door 5 relative to the housing 2 is thereby adjusted. In particular, a modification of the gap 8 is also possible in the embodiment illustrated herein. Once this adjustment has been made and the gap size has been adjusted as desired, this adjusted position can be fixed by screwing the locking screw 27 in again and thus tightening it. FIG. 6 also shows the relative movement of the bearing angle adjustment plate 17 relative to the bearing angle base plate 21 by using an arrow P. It can be seen in FIG. 4, FIG. 5 and FIG. 6 that the bearing angle adjustment plate 17 lies directly on top of the upper side of the bearing angle base plate 21, in such a way that these two plates 17 and 21 extend in parallel planes. It can also be seen that the locking screw 27 is oriented in a spatial direction perpendicular to the width direction and hence perpendicular to the orientation of the readjustment element 24, which is specifically an orientation in the height direction, and it is therefore easily accessible from above as can also be seen in FIG. 2.

In particular, the embodiment explained in this case is also correspondingly provided at a bottom end of the door 5 in a height direction, in such a way that a corresponding bearing device 12 and a corresponding adjustment device 16 are provided there. A corresponding access channel 15 is also formed there.

The following is a summary list of reference numerals and the corresponding structure used in the above description of the invention:

LIST OF REFERENCE CHARACTERS

1 Household refrigeration appliance
2 Housing
3 Storage space
4 Door
5 Door
5*a* Door leaf
6 Storage space
7 Door
8 Gap
9 Gap
10 Gap
11 Corner region
12 Bearing device
13 Front flange

14 Gap
15 Access channel
16 Adjustment device
17 Bearing angle adjustment plate
18 Engagement pin
19 Engagement peg
20 Opening
21 Bearing angle base plate
22 Guide peg
23 Engagement peg
24 Readjustment element
25 Insertion region
26 Support
27 Locking screw
28 Opening
29 Opening
30 Opening
31 Guide slot
32 Tool
A Swivel axis
P Arrow

The invention claimed is:

1. A method for adjusting a position of a door on a housing of a household refrigeration appliance to change a placement of the door while located on the housing, the method comprising the following steps:

separating a door leaf of the door from a front flange of the housing by a gap in a depth direction of the household refrigeration appliance in a closed state of the door;

inserting a tool into the gap; and using the tool to readjust a readjustment element being accessible through the gap for changing the position of the door relative to the housing in dependence on the readjustment of the readjustment element.

2. The method according to claim 1, which further comprises providing a lateral opening of the gap in a width direction of the household refrigeration appliance, introducing the tool laterally in a width direction into an access channel of the gap, and engaging the readjustment element with the tool.

3. The method according to claim 1, which further comprises readjusting the readjustment element in a width direction of the household refrigeration appliance in order to change the position of the door relative to the housing.

4. The method according to claim 1, which further comprises:

using a bearing device to pivotably mount the door on the housing;

providing the bearing device with a bearing angle adjustment plate being rotatably connected to the door and with a separate bearing angle base plate being statically located on the housing;

using the readjustment element to connect the bearing angle adjustment plate to the bearing angle base plate; and moving the bearing angle adjustment plate and the bearing angle base plate linearly relative to each other by operating the readjustment element in order to effect a change in the position of the door relative to the housing.

5. The method according to claim 4, which further comprises moving the bearing angle adjustment plate linearly in a width direction of the household refrigeration appliance relative to the bearing angle base plate in order to change the position of the door relative to the housing.

6. The method according to claim 4, which further comprises:

providing the bearing angle base plate with an engagement peg passing through an opening in the bearing angle adjustment plate;

connecting the readjustment element to a section of the engagement peg passing through the opening and to an engagement peg of the bearing angle adjustment plate; and aligning the engagement peg of the bearing angle adjustment plate and the engagement peg of the bearing angle base plate parallel to each other.

7. The method according to claim 4, which further comprises fixing an adjusted relative position between the bearing angle adjustment plate and the bearing angle base plate.

8. The method according to claim 7, which further comprises tightening a locking screw in order to fix the adjusted position.

9. The method according to claim 8, which further comprises tightening the locking screw in a direction perpendicular to a readjustment direction of the plates.

10. The method according to claim 1, which further comprises adjusting the position of the door when the door is in the closed state.

11. The method according to claim 1, which further comprises providing an adjustment screw as the readjustment element, and adjusting the position of the door by rotating the adjustment screw.

12. A household refrigeration appliance, comprising:

a housing having a front and a front flange;

a storage space disposed in said housing for storing food;

a door pivotably disposed on said housing for closing said storage space at said front of said housing;

said door and said front flange forming a gap therebetween at least in a closed state of said door, said gap providing an access channel;

a tool to be introduced into said access channel; and an adjustment device being accessible by said tool through said access channel for adjusting a position of said door relative to said housing, said adjustment device having a readjustment element located for direct engagement and readjustment by said tool introduced into said access channel for adjusting said position of said door in dependence on said readjustment by said tool.

* * * * *